US005887906A

United States Patent [19]

Sultan

[11] Patent Number: 5,887,906

[45] Date of Patent: Mar. 30, 1999

[54] TYPE OF INSTANT SCRATCH-OFF LOTTERY GAMES

[76] Inventor: Hashem Sultan, 8455 Island Pines Pl., Mainville, Ohio 45039

[21] Appl. No.: 999,251

[22] Filed: Dec. 29, 1997

[51] Int. Cl.[6] ..... B42D 15/00

[52] U.S. Cl. ..... 283/94; 285/901; 285/111; 285/903; 273/139

[58] Field of Search ..... 283/94, 111, 901, 283/67, 903, 70; 273/139, 269

[56] References Cited

U.S. PATENT DOCUMENTS

| | | | |
|---|---|---|---|
| 5,074,566 | 12/1991 | Desbiens | 283/903 X |
| 5,118,109 | 6/1992 | Gumina | 273/139 |
| 5,411,260 | 5/1995 | Smith | 283/903 X |
| 5,690,367 | 11/1997 | Fromer | 283/94 |

*Primary Examiner*—Willmon Fridie, Jr.
*Attorney, Agent, or Firm*—Wood Herron & Evans LLP.; Kurt Summe

[57] ABSTRACT

A new type of instant scratch-off lottery game combining the advantages of the conventional lottery, which allows the player to choose his own selected numbers from a set of numbers, and the advantage of the instant scratch-off lottery tickets by enabling the player to immediately learn if he is a winner or a looser. The player is instructed to pick his numbers from a set of numbers. Each number in this set is represented by a a small box overprinted with a security bar-code readable to conventional scanner. The scanner transfer the readable data and the serial number of the ticket to a central computer in the lottery agency to verify the winning status. The player is able to learn immediately if he is a winner by revealing a winning symbol hidden under the scratch-off material and the overprinted security code of the picked numbers.

19 Claims, 6 Drawing Sheets

TYPE OF INSTANT SCRATCH-OFF LOTTERY GAMES

FIELD OF THE INVENTION

The invention relates to instant scratch-off lottery games in general, and to means for preventing fraudulent alteration of the ticket.

BACKGROUND OF THE INVENTION

Instant scratch-off lottery tickets are being increasingly sold around the world.

Instant scratch-off lottery tickets contain hidden preprinted winning and losing game data which distinguishes this form of lottery from the various other forms in which winning numbers are drawn some time after the sale of the ticket (State conventional lottery).

This scratch-off lottery utilizes a ticket, card or other paper imprinted with indicia such as information relating to certain numbers, symbols, words and the like which indicate whether the bearer has won a prize. Such tickets must obscure the win indicating information from observation by both the ticket distributor and the ticket purchaser as well until after the ticket has been sold. In this way, neither the ticket distributor nor the purchaser can determine which of a large number of tickets contain the win indicating information.

After the ticket is purchased, the purchaser removes the material which obscures the imprinted thereon. Once this coating is removed, the purchaser will know if he holds a winning ticket.

The games of the instant scratch lotteries are generally of five main types:

1-Match three amounts or symbols and win that amount

2-Match any of your preprinted numbers to another preprinted set of numbers and wins a predetermined amount.

3-Bingo type game

4-Compare your preprinted numbers or playing cards to a preprinted number(s) or playing cards. You win if you get higher numbers . . . etc.

5-You win if you have a preprinted winning symbol in your card.

All of the above categories of games and all the other currently available instant lottery games have a predetermined number of winning tickets. The ticket has the winning indicia are sold randomly among the other tickets. Purchaser has no role in making the ticket he buys a winning one, nor he has the choice of entering his lucky numbers as he does in purchasing the conventional lottery ticket.

Players feel more satisfaction if they can choose their own numbers compared to having a ticket with preprinted winning indicia.

The current invention provides the combined advantages of the conventional lottery by allowing the purchaser enter his chosen number and the advantage of the instant scratch-off lottery tickets by enabling the purchaser to immediately learn if the ticket is a winner or a looser.

It is, therefore, a prime object of the current invention to provide a novel type of instant lottery scratch-off games in which any ticket could be a winning one if the player entered the correct numbers printed on that particular ticket.

It is another object of the present invention to provides new endless varieties of games where only the player has a major input and contribution to make the ticket a winning one.

It is another object of this invention to provide the player with a prior knowledge of the amount of prize and the probability of winning for each particular game.

It is another object of the current invention to create more trust and confidence with the lottery agency by making the player choose his own numbers.

It is another object of the current invention to provide a method for defeating any technique for nondestructive premature reading of the winning number printed on the card by providing a security bar code over-printed on the scratch-off material which covers the boxes which correspond to each number.

This security bar codes will enable the lottery ticket distributor to transfer the information to a central computer of the lottery agency to approve or disapprove the payment of the prizes of the winning tickets.

In view of the above shortcomings of the instant lottery tickets, there is a need in the lottery business for a new type of games which combines the advantages of traditional lottery games by allowing players to choose their own numbers and the advantage of the instant scratch-off ticket by allowing immediate learning if the ticket is a winner or a looser.

SUMMARY OF THE INVENTION

The current invention relates to the structure of a game card of the instant scratch-off type of lotteries.

The current invention provides the combined advantages of the conventional lottery which allows the player to choose his own number to determine his chance of winning, and the advantage of the instant scratch-off lottery tickets by enabling the player to immediately learn if the ticket is a winning or a loosing one.

It is another object of the invention to provide a method to ensure whether or not the ticket is invalidated by revealing more data than the player is allowed. This is acheived by a bar-code, readable to a scanner, covering each box representing the number of set of numbers printed on the card.

The current invention provides plurality of games allowing the player to pick his own number which varies with each particular game, which could be pick 1, 2, 3, 4, 5, 6 or more from a set of number. Each number of this set is represented by a box covered by the scratch-off material which is over-printed with an appropriate bar-code readable to a scanner (Such scanners are already widely used in stores).

The winning number for each ticket is chosen randomly by a central processor of the lottery agency and stored in its data associated with the serial number of the ticket which is also printed on the card as a bar code readable to scanners. The winning numbers are marked by symbol inside the corresponding boxes and are hidden by the scratch-off material and the over-printed security bar code. The winning numbers are unique for each card.

The player is instructed to remove only the material covering the boxes which corresponds to the numbers he had chosen. If he reveals more boxes than he is allowed for that particular game the card is invalidated and the player looses even if he reveals the correct numbers.

For example, If the player is playing the pick 3 games, he is instructed to choose only three numbers of a set of numbers printed on the card. He has to remove only the scratch-off material covering the boxes (or fields) of his three selected numbers.

The ticket distributors are provided with scanners, (not part of the invention, already available in the market), that can read the serial number of the ticket and the security bar code for each box number to verify that winning numbers are revealed and that only certain numbers of the fields are revealed and the covering security bar codes of the rest of the fields are not violated. The information thus obtained are transferred to the central processor of the lottery agency to approve or disapprove the payment of the prizes.

DETAILED DESCRIPTION OF THE INVENTION

The current invention relates to the structure of a game card of the instant scratch-off type of lotteries.

Figure 1:
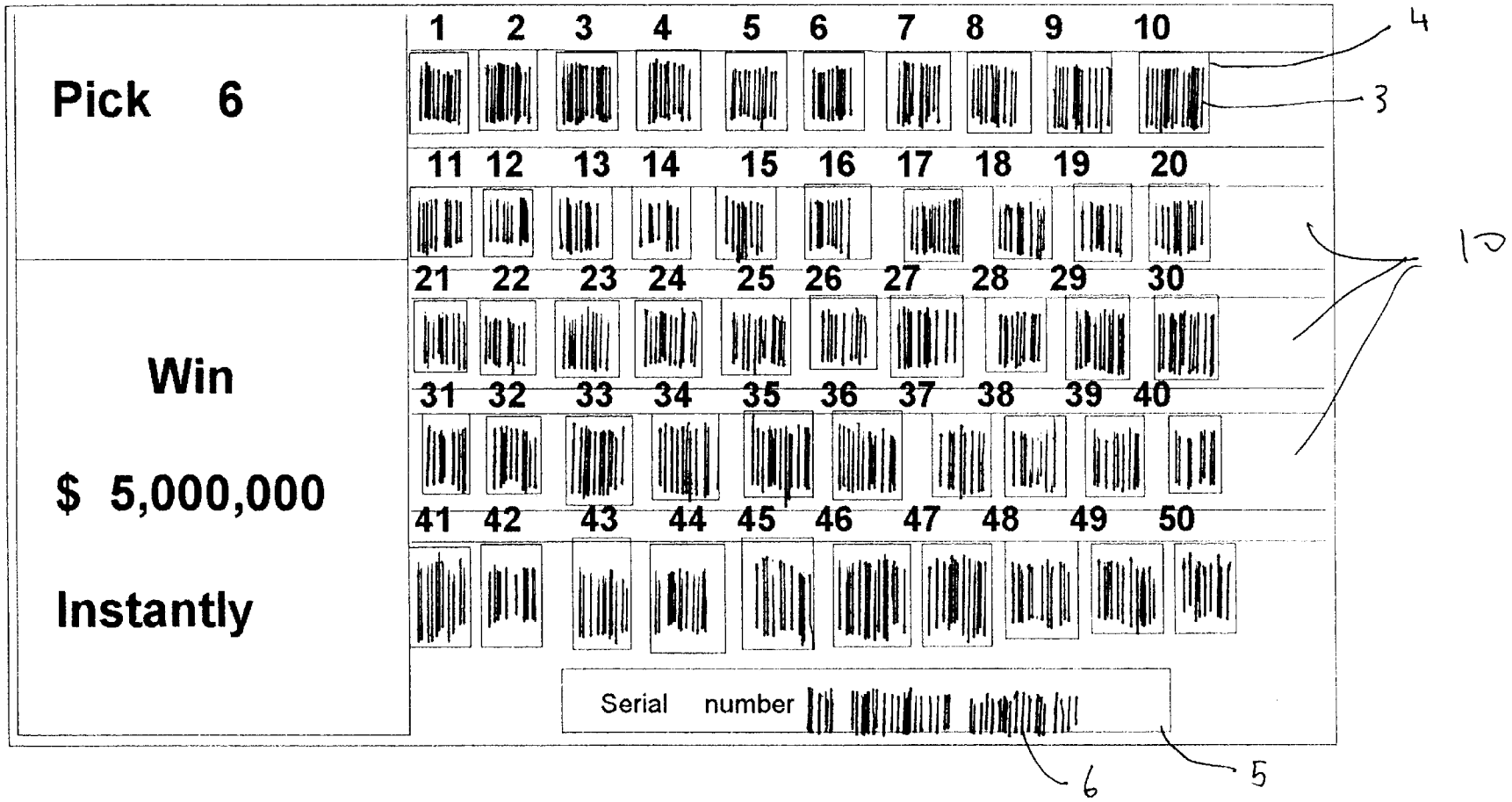
FIG. 1 is a rough drawing of a ticket for pick 6 numbers showing the numbers and their corresponding boxes covered with a security bar code.

In FIG. 1 an example of the games proposed is illustrated. The manufacturing of these kinds of tickets is well known to those ordinary skill in the art and is beyond the scope of this invention.

The card needs to be made of multi-layered card protected against see-through difficult to forge in which the hidden data is printed with an ink having no or minimal radio opacity such as described by Silverschotz et al U.S. Pat. No. 5,542,710 and Meloni et al U.S. Pat. No. 4,787,950, and by Hansell U.S. Pat. No. 5,407,535 and by Goldman in U.S. Pat. No. 4,191,376.

The card is overprinted with a group of numbers 10. The group may consist of any amount of numbers which varies with the type of game played and the rules set by the lottery agency.

Each number of this group is represented by a small box 4 or area or a game field of any other shape like a circle, heart, etc. The box is covered with a printed security bar code 3 representing the number. This security code is readable to ordinary scanner available in almost every store. It should be noted that this security code need not be of the bar code type, any symbol readable to scanners can be used.

Figure 6:
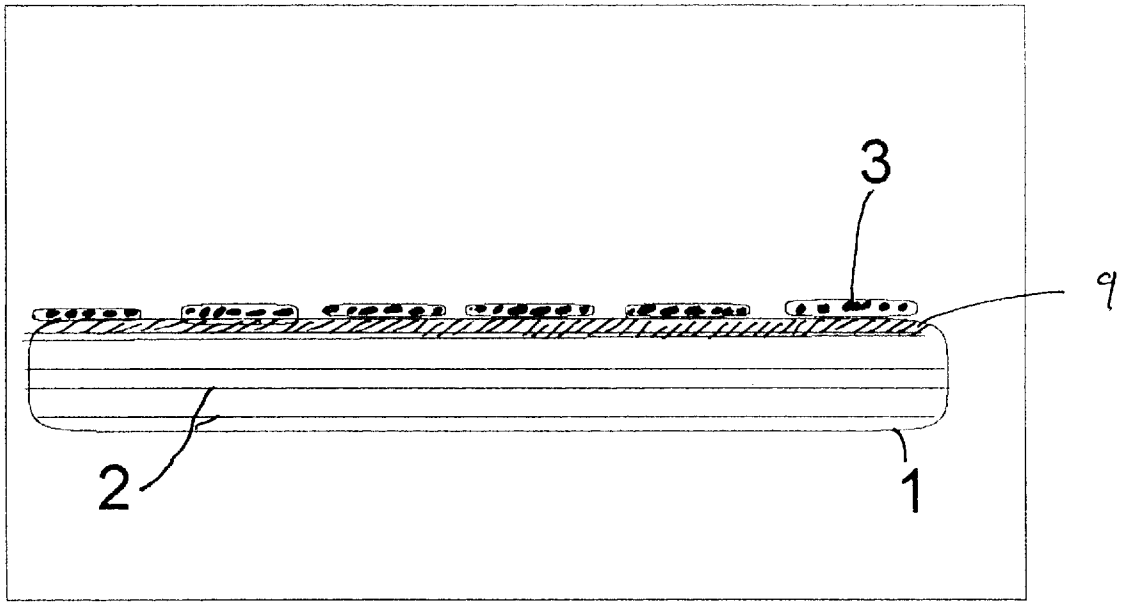
FIG. 6 is a rough drawing of a cross section of the lottery ticket showing the security bar codes 3 over printed on the scratch-off material 9.

In FIG. 6 a sectional view of the card is illustrated showing the security code 3 overprinted on the scratch-off material 9 which is coating the other layers 2 of the card 1.

The card has a field 5 for the serial number of the card as well its readable bar-code 6 by scanners. The bar code is printed on the card itself and may or may not be coated with scratch-off material for covering the serial number and its readable bar-code.

The serial number will indicate the predetermined numbers of the field the player is allowed to reveal its content; example 03-000 0000 00000 indicate that the card is a pick only 3 fields, and 05-000 00000 indicate that the card is a pick only 5 fields.

The rest of the serial number is the number of the ticket associated with the predetermined winning numbers chosen randomly by the central processor of the lottery agency.

Instruction of the rules of the game is overprinted with the amount of the prizes. for example in FIG. 1 the player is instructed to pick only six numbers, by scratching off the material covering the corresponding six fields to reveal the contents of those fields, from a group of the fields 10. If the player revealed more than six fields the ticket will be invalidated. This can be immediately recognized by the scanners reading the ticket.

Each ticket has a winning numbers chosen randomly by a central computer processor in the lottery agency and the winning numbers are stored with their corresponding serial number in the computer. The winning numbers of selectable game fields (e.g. 1–6 fields) are associated with the serial number of each ticket.

To verify a winning ticket the computer should compare the numbers whose security code is erased by removal of the scratch-off with the serial number of the ticket and that only certain number of fields as instructed are chosen by the player (like six fields in pick 6 game) by verifying the integrity of the security codes over the rest of the fields which correspond to the numbers.

Figure 2:
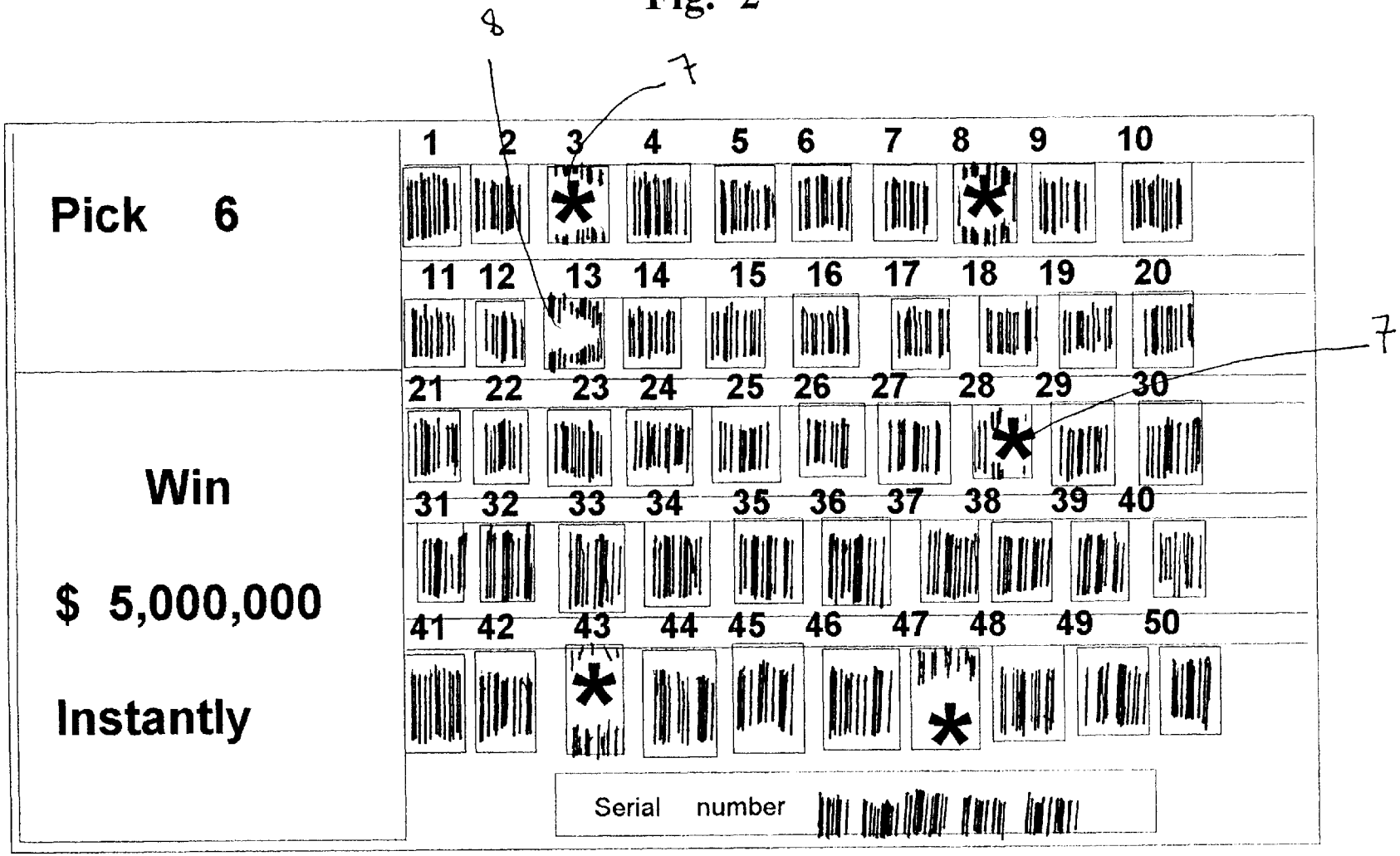
FIG. 2 is a rough drawing of a ticket for pick 6 numbers, with a player entered six numbers 3, 8, 13, 28, 43, and 47. The player matched 5 numbers of the six.

FIG. 2 shows that by scratching off the security code of the numbers chosen by a player he will immediately learn if he chooses the fields with winning numbers or symbols or not.

Winning numbers are indicated by hidden symbol 7 in the boxes 4 of the numbers. The symbol can be a letter, another number, a word, a certain color or any other mark or indicator determined by the lottery agency.

It is shown in FIG. 2 as an example, the player has chosen fields number 3, 8, 13, 28, 43, and 47. The winning numbers were 3, 8, 28, 35(which the player did not choose and is still hidden by the security code), 43, and 47. As seen the field of number 13 does not have the winning symbol and therefore represented by either empty field 8 or another symbols to indicate non-winning number.

Prizes vary with each particular game and the probability of winning for each game.

In general the probability of winning for any lottery game is the product of the probability of winning of each one attempt multiplied by the numbers of attempts. Therefore, in the conventional lottery of Ohio super lotto where players has to choose six numbers from 1 to 47 the probability for each one ticket is 1/10,737,573. If the volume of sale of tickets exceeds 10 millions tickets the probability of a winner approaches % 100.

For the same game (Pick 6 from 1 to 47) on the current invention the probability for each player remains the same 1/10,737,573, but the probability of a winner remains 1/10, 373,573, because each winning number on a particular card is always played once only.

This will give the lottery agency tremendous benefits. The purchaser, on the other hand, as an individual is not affected, his chance of winning remains the same whether he played the same game on the conventional lottery or the scratch-off type, but has the advantage of learning immediately whether he is a winner or not.

By reducing the probability of having a winner, the lottery agency has a great benefit and allow them to increases the chance and the amount of winning for the player, which generally improves the chance of the player to be a winner compared to the conventional lottery.

For example, In Ohio super lotto (Pick 6 from 1 to 47) matching 4 out of six with a probability of 1/11891 wins only $70–120.

With the current invention for the same game, the lottery agency can increase the prize up to $10,000, or can increase the chance of winning by awarding match 3 or 2 numbers out of the six.

Overall, the current invention increase the chance of winning and benefits for the players as well as the lottery agency.

Figure 3:
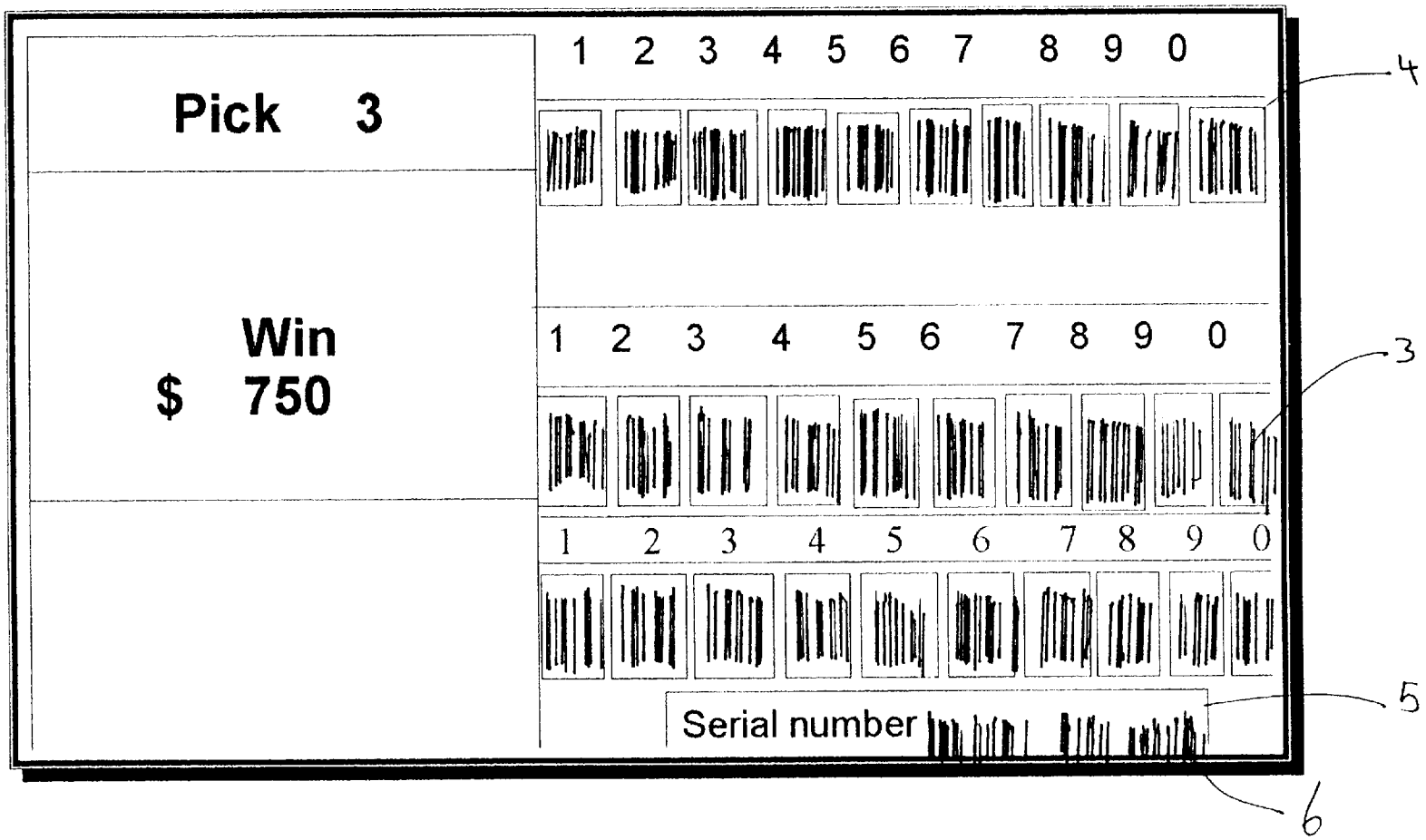
FIGS. 3, 4, and 5 shows examples of different types of playing pick 3 number with different probability of winning and hence different prizes.
Figure 4:
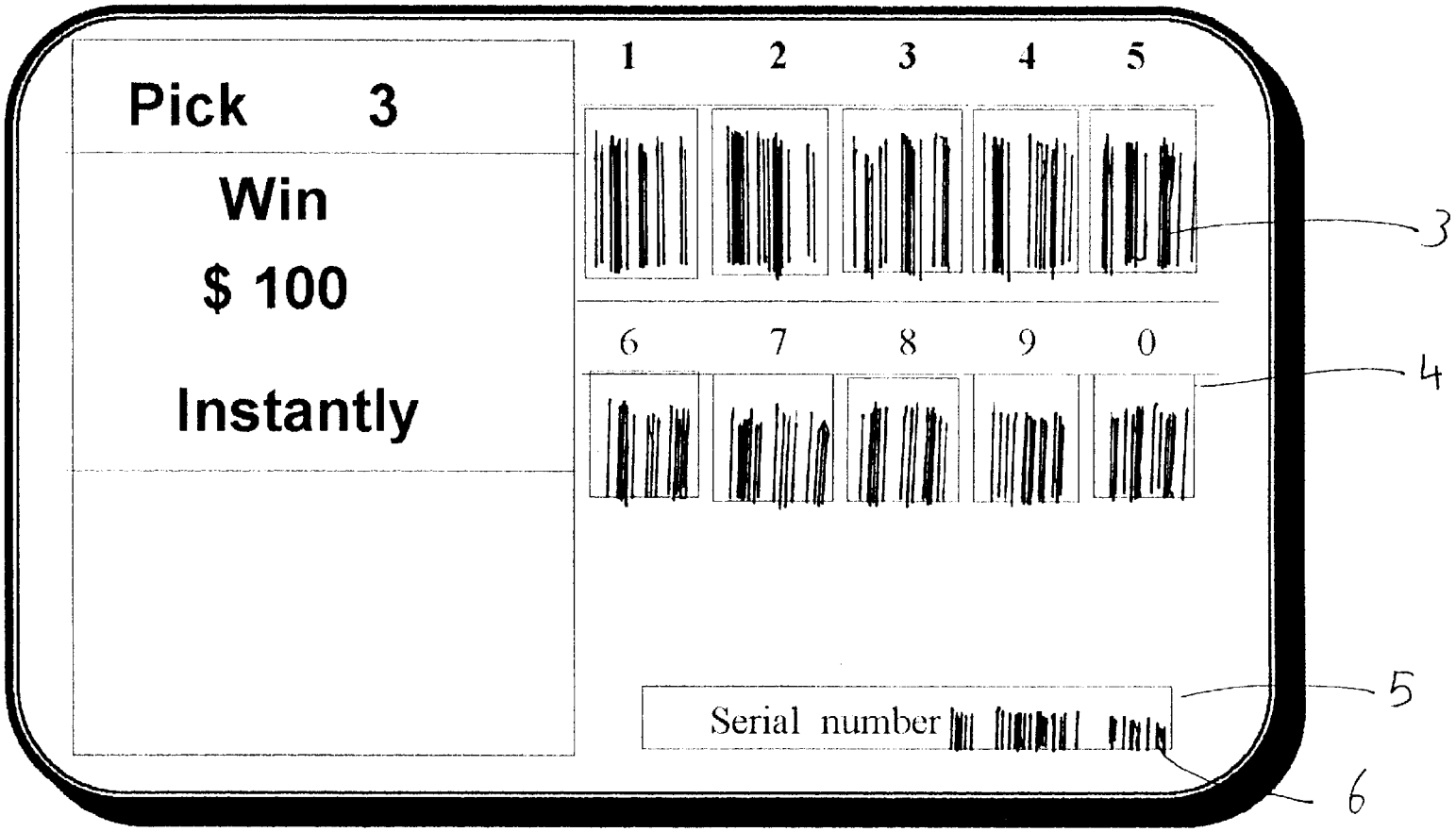
Figure 5:
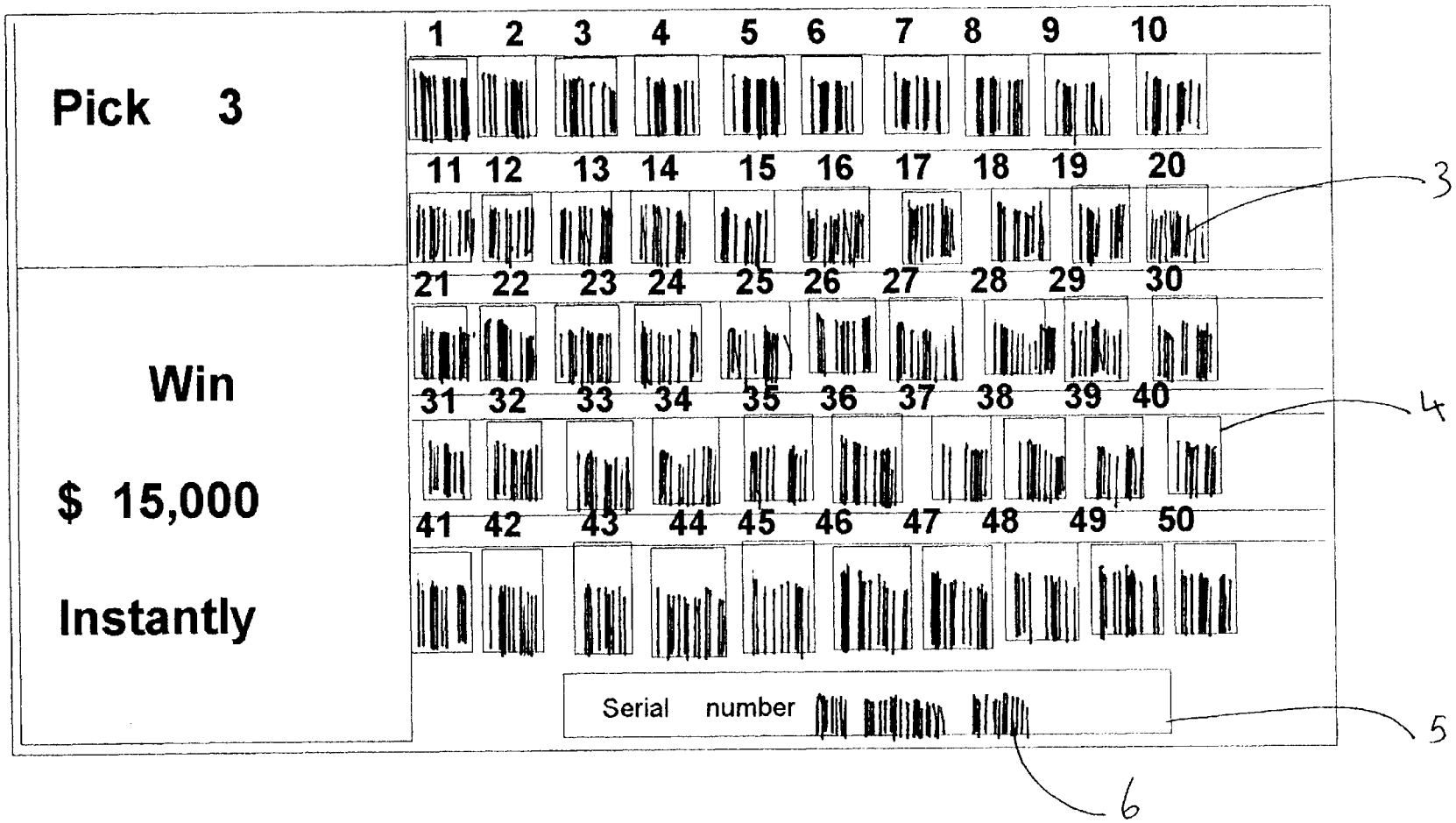

FIGS. 3, 4, 5, shows some of the varieties of games with the prizes vary with changing the set of numbers the player has to choose from.

While this invention has been described as having a preferred design, it is understood that it is capable of further modification, uses and/or adaptations of the invention following in general the principle of the invention and including such departure from the present disclosure as come within the known or customary practice in the art to which to invention pertains and as may be applied to the central feature herein before set forth, and fall within the scope of the invention and the limits of the appended claims.

An example of this modification is the association of the fields with letters or symbols or even no association with anything, just presenting fields as fields for selection by a player.

What is claimed is:

1. A tamper resistant lottery ticket for preventing payoff of invalid tickets comprising:

a ticket body;

a plurality of numerical symbols formed on the ticket body, a game field associated with each of said numerical symbols on the body, the game fields choosable by a lottery player;

at least one winning symbol for the ticket positioned in a game field and associated with a numerical or non-numerical symbol;

a scratch-off material covering the game fields to hide contents of the game fields and therefore hide the at least one winning symbol, the scratch-off material removable by a lottery player to reveal the contents of a game field when the game field is chosen;

a readable security code printed on the scratch off material of the game fields, the security code being removable when the scratch-off material is removed to reveal the game field contents;

whereby the security codes of the ticket may be read to ensure that the proper number of game field contents are revealed and the lottery ticket is valid.

2. The tamper resistant lottery ticket of claim 1 further comprising a serial number field, the serial number field including a serial number of the ticket associated with at least one of said game fields containing a winning symbol.

3. The tamper resistant lottery ticket of claim 2 wherein said serial number include a readable serial number code.

4. The tamper resistant lottery ticket of claim 2 wherein said serial number is also associated with the number of game field contents which may be revealed for the ticket for a valid ticket.

5. The tamper resistant lottery ticket of claim 1 further comprising a plurality of winning symbols in the game fields.

6. The tamper resistant lottery ticket of claim 5 wherein said plurality of winning symbols is a predetermined number of winning symbols for fixing the proper number of game fields which are revealable.

7. The tamper resistant lottery ticket of claim 1 wherein said readable security code is a bar code.

8. The tamper resistant lottery ticket of claim 2 wherein said readable serial number code is a bar code.

9. A tamper resistant lottery ticket for preventing payoff of invalid tickets comprising:

a ticket body;

a plurality of game fields formed on the body, the game fields choosable by a lottery player;

a scratch-off material covering the game fields to hide contents of the game fields, the scratch-off material removable by a lottery player to reveal the contents of a game field when the game field is chosen;

a readable security code printed on the scratch-off material of the game fields, the security code being removable when the scratch-off material is removed to reveal the game field contents;

whereby the security codes of the ticket may be read to ensure the proper number of game field contents are revealed and the lottery ticket is valid.

10. The tamper resistant lottery ticket of claim 9 further comprising a serial number field, the serial number field including a serial number for the ticket associated with at least one of said game fields.

11. The tamper resistant lottery ticket of claim 10 wherein said serial number includes a readable serial number code.

12. The tamper resistant lottery ticket of claim 10 wherein said serial number is also associated with the number of game field contents which may be revealed for the ticket for a valid ticket.

13. The tamper resistant lottery ticket of claim 9 wherein said readable security code is a bar code.

14. A method of playing a lottery game with tickets and preventing payoff of an invalid lottery ticket comprising:

providing a ticket to a player having a plurality of game fields thereon which are choosable by a lottery player;

providing a scratch-off material on the ticket for covering the game fields to hide contents of the game fields, the scratch-off material being removable by a lottery player to reveal the contents of a game field when the game field is chosen by the player;

providing a readable security code on top of the scratch-off material of the game fields, the security code being removable when the scratch-off material is removed to reveal the game field contents;

instructing the lottery player to choose a predetermined number of the game fields and to remove the scratch-off material and the readable security code for the chosen game fields to reveal the contents of the game fields;

reading the security codes of the game fields after the lottery player has chosen to determine the number of game fields having the scratch-off material removed by the player;

comparing the game fields with the scratch-off material removed to the predetermined number of game fields to determine if the proper number of game fields were chosen by the player;

determining the validity of the lottery ticket based upon said comparison step.

15. The method of claim 14 further comprising providing a serial number field on the ticket, the serial number field including a serial number for the ticket associated with the predetermined number of choosable game fields.

16. The method of claim 15 wherein said serial number includes a readable serial number code.

17. The method of claim 15 further comprising reading serial number to determine the predetermined number of choosable game field for a valid ticket.

18. The method of claim 14 wherein at least one of said game fields includes a winning symbol positioned therein to indicate a winning game field on the ticket.

19. The method of claim 14 wherein said readable security code is a bar code.

* * * * *